United States Patent [19]

Brazier

[11] 4,287,636

[45] Sep. 8, 1981

[54] APPARATUS FOR CLEANING FLOOR, CARPETS AND THE LIKE

[75] Inventor: Alan J. Brazier, Birmingham, England

[73] Assignee: Vax Appliances Limited, Droitwich, England

[21] Appl. No.: 101,542

[22] Filed: Dec. 10, 1979

[30] Foreign Application Priority Data

Dec. 19, 1978 [GB] United Kingdom ..... 49174/78

[51] Int. Cl.[3] ..... A47L 7/00

[52] U.S. Cl. ..... 15/321; 15/328

[58] Field of Search ..... 15/320, 321, 328, 353

[56] References Cited

U.S. PATENT DOCUMENTS

| | | | |
|---|---|---|---|
| 2,949,620 | 8/1960 | Noble | 15/321 X |
| 3,056,994 | 10/1962 | Noble | 15/321 |
| 3,180,071 | 4/1965 | Nolte | 15/328 X |
| 3,720,977 | 3/1973 | Brycki | 15/353 X |
| 4,216,563 | 8/1980 | Cyphert | 15/353 X |

*Primary Examiner*—Chris K. Moore

*Attorney, Agent, or Firm*—Claude A. S. Hamrick

[57] ABSTRACT

A dual purpose suction cleaning apparatus includes an open-topped container adapted for the collection of a liquid and a motor driven air suction unit for applying suction to the container. In use, either a detachable reservoir unit, or a detachable connector member is interposed between the air suction unit and the container so that in the one case the apparatus serves as a water extraction cleaner, whereas in the other case it operates as a normal dry vacuum cleaner. The interchangeable reservoir unit and connector member are each formed as self-contained units by means of which the exhaust air flow from the suction unit is directed by the reservoir unit so as to displace liquid therefrom, but is diverted to atmosphere by the connector member. A filter element for dry dust collection may be incorporated in the connector member or a separate dust collecting bag may be provided in the container.

6 Claims, 4 Drawing Figures

10
11
12
14
20
21
26
27
28
29
30
31
32
33
34
35
36
37
38
39
40
41
50
51
52
53
54
55
56
57
58
59
60
61
62
63
64
65
66
67
70
71
72
A
B

APPARATUS FOR CLEANING FLOOR, CARPETS AND THE LIKE

BACKGROUND OF THE INVENTION

1. Field of the Invention

This invention relates to apparatus for cleaning floors, walls, carpets, curtains, upholstery and the like. The invention is more particularly concerned with a dual purpose apparatus suitable for both dry suction cleaning and water extraction cleaning processes.

In the process of water extraction cleaning, a carpet or the like is thoroughly wetted by a solution containing a suitable cleansing agent, such as a nonfoaming detergent, and the carpet or the like is then substantially dried by uptake of the solution by suitable suction apparatus.

2. Description of the Prior Art

Various types of dual purpose appliances have been proposed in previous publications, but none appears to have met with any degree of commercial success. For example, British Patent Specification No. 1,121,225 discloses an attachment for use with an external source of suction, such as a conventional dry suction cleaner (vacuum cleaner) wherein a clean water reservoir is provided within a soiled water collection container, and liquid from the reservoir is delivered by virtue of the reduced pressure in a cleaning head to which suction from the external source is applied by way of the collection container. Whilst such an attachment can be used with a conventional vacuum cleaner to provide the additional function of a wet cleaning process, it has a number of disadvantages. In particular, the provision of the clean water reservoir within the collection container greatly restricts the volume of liquid that can be collected; delivery of the clean liquid by suction established in the cleaning head results in the liquid being drawn away before it effectively penetrates the carpet being cleaned; and as the attachment may be used with any conventional vacuum cleaner, it is impossible to be certain that the suction power available will be sufficient to operate the attachment efficiently. Additionally, such an attachment is relatively expensive to produce since it utilises only the suction means of the conventional cleaner with which it is used and not the collecting capacity thereof.

Another approach is shown in U.S. Pat. No. 3,079,626. This shows a dual purpose cleaner which is effectively two separate appliances which share a single suction unit that is designed to be assembled with either of the appliances. This arrangement is again unduly costly for ordinary domestic use where the vacuum cleaning appliance is likely to be in daily use and the wet process cleaning appliance may only be used for a few days in the year.

A rather different approach is shown in German Pat. No. 2,539,832. This shows an appliance which incorporates a dust filter and a clean water reservoir at the same time, so that either function may be employed at any time. However, in this case the reservoir reduces the collecting capacity of the container even when the appliance is in use as a dry vacuum cleaner, and moreover a separate pump is provided to dispense the cleaning liquid when required. Whilst the additional expense involved in providing such a separate pump may be acceptable for a commercial or industrial cleaning appliance, it is not acceptable in an appliance intended mainly for domestic use.

With a view to overcoming these disadvantages and providing a dual purpose appliance which is suitable for domestic use, the Applicants have already proposed in their U.S. patent application No. 905,417 a dual purpose appliance in which a clean water reservoir and a filter unit are interchangeably assembled with a suction unit and a collection container in such a manner that the exhaust air from the suction unit is utilised to deliver liquid from the reservoir when the latter is in use, and the full volume of the container is available for collecting dry matter when the filter is in use. The present invention provides an improved arrangement whereby means for control of the exhaust air flow is built into the interchangeable parts of the appliance and obviates the need for movable parts to direct such air flow along different paths according to the function for which the appliance is set up.

SUMMARY OF THE INVENTION

According to the present invention suction cleaning apparatus comprises container means for the collection of both wet and dry matter and having an intake inlet for connection with a cleaning head; motor driven air suction means with an air exhaust outlet and an air inlet; detachable reservoir means for storing cleaning liquid; delivery means for delivering said liquid from said reservoir means to said cleaning head in response to the establishment of air pressure within said reservoir means so as to enable the apparatus to be used for wet cleaning; detachable connector means for connecting said suction means to said container means, said reservoir means and said connector means being interchangeably assembled with said container means and suction means so that the connector means is used in the absence of said reservoir means and vice-versa; filter means for assembly with said container means when said connector means is assembled therewith so as to enable the apparatus to be used alternatively for dry suction cleaning; an air passageway in said reservoir means extending, when said reservoir means is assembled with said container means and said suction means, from the interior of said container means to the air inlet of said suction means so as to apply suction to the interior of said container means whilst isolating said air exhaust outlet of the suction means from said container means so that air delivered from said air exhaust outlet enters said reservoir means externally of said air passageway; and airflow director means incorporated in said connector means for directing air, when said connector means is assembled with said container means and said suction means, from said exhaust outlet of the suction means to atmosphere whilst placing the interior of said container means in communication with said air inlet of the suction means.

Thus, when the reservoir means is in position on the container means and the suction means is positioned on the reservoir means, exhaust air from the suction means causes liquid to be delivered from the reservoir means to a suitable cleaning head, whilst the air inlet of the suction means is placed in communication with the interior of the container means so that suction is applied thereto, and hence to a suction cleaning head. Alternatively, when the connector means is connected between the container means and the suction means the exhaust air is diverted to atmosphere, and the air inlet communicates with the interior of the container so that the apparatus may be used with the provision of said filter means for dry suction cleaning without other modification or adjustment.

The apparatus is thus readily convertible so as to operate in either of its modes without requiring any special setting up by the user.

Figure 1:
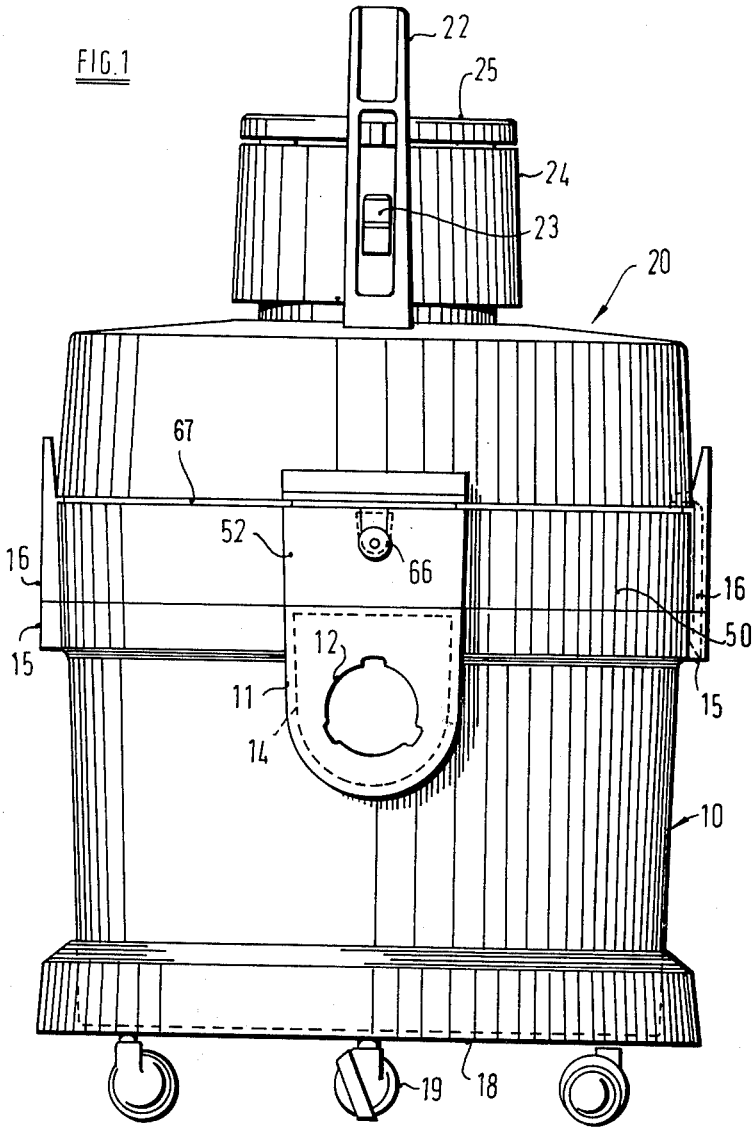
FIG. 1 shows a preferred embodiment of suction cleaning apparatus in front view with a removable clean water reservoir unit in position.
Figure 2:
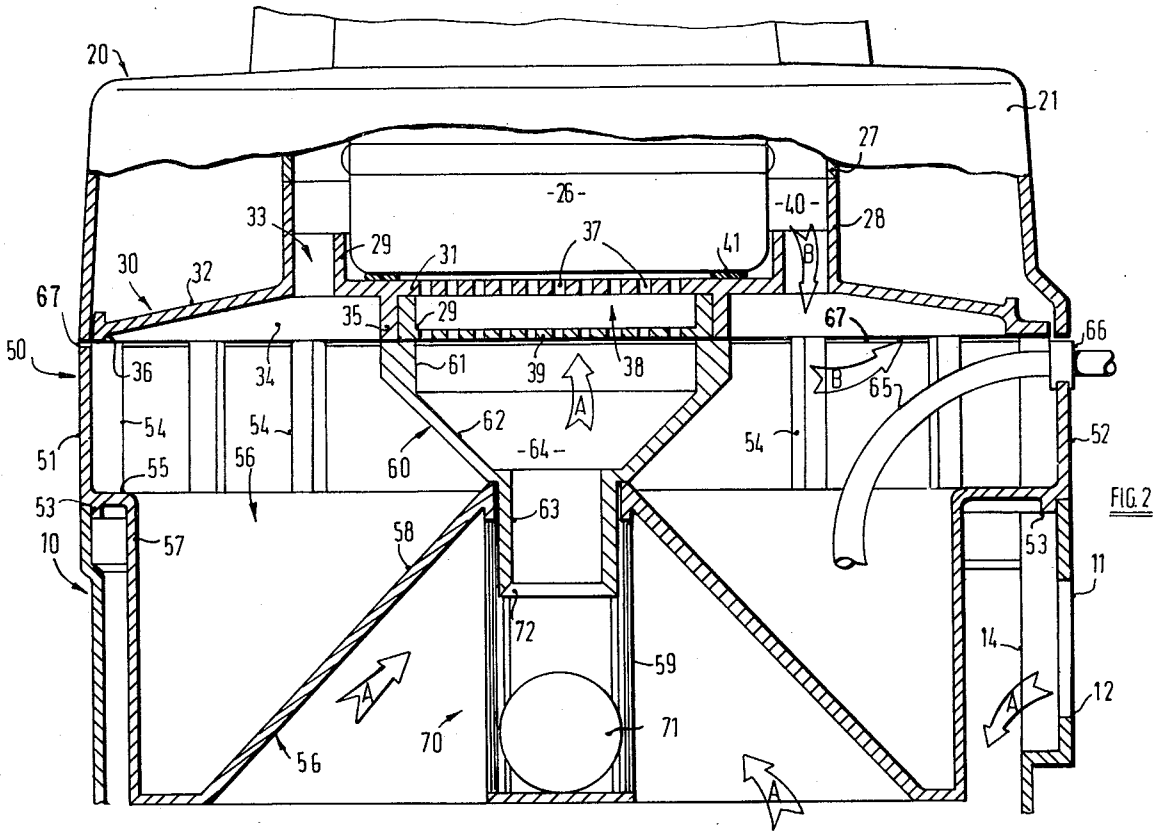
FIG. 2 shows a partial transverse section on the line A—A of FIG. 1.
Figure 3:
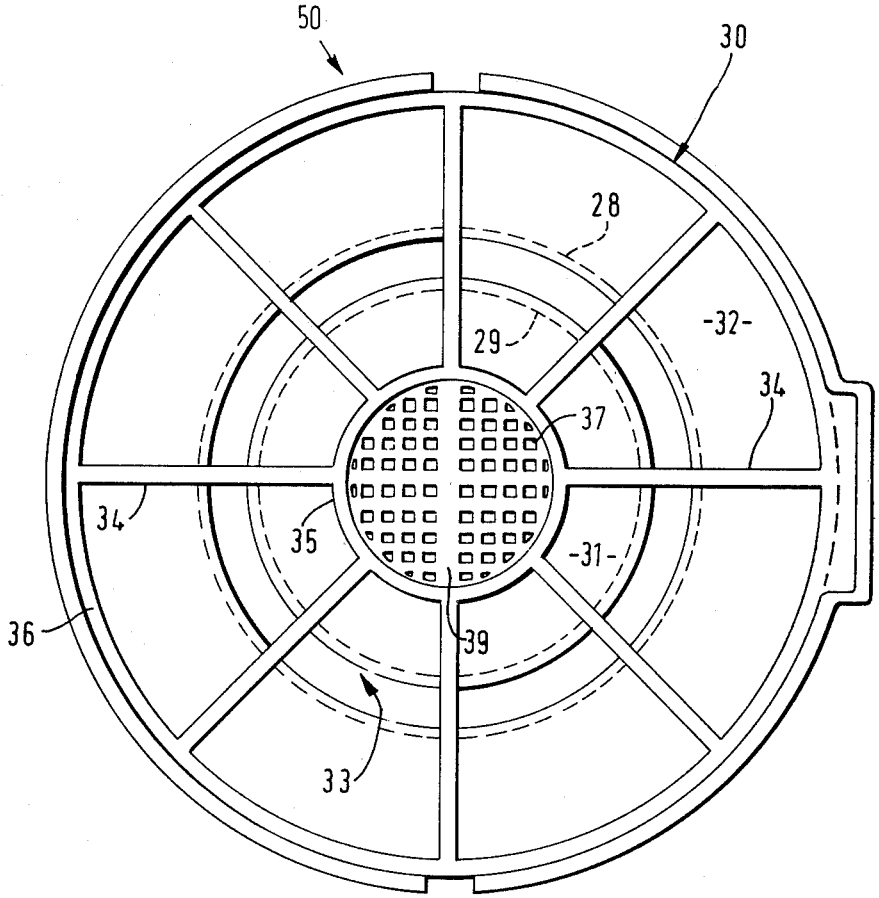
FIG. 3 is a view showing the underneath plan of a detachable suction unit.
Figure 4:
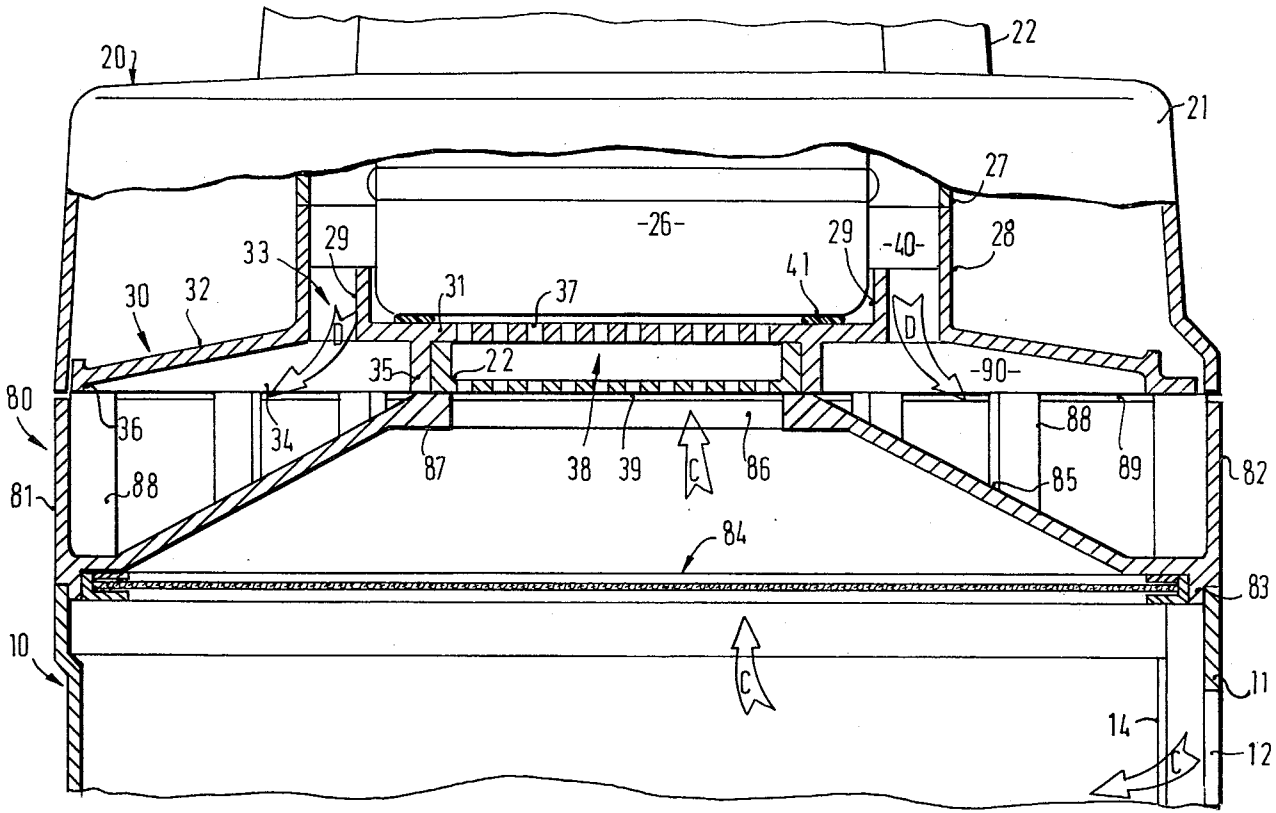
FIG. 4 is a partial transverse section corresponding to FIG. 2 but showing a connector member incorporating a dust filter assembly in place of the reservoir unit.

The suction cleaner illustrated in the accompanying drawings includes a main container 10 and an air suction unit 20 with the inter-position of either a reservoir unit 50, as shown in FIGS. 1, 2 and 3 if the cleaner is to be used for water extraction cleaning, or a connector member 80 as shown in FIG. 4 if it is to be used for dry suction cleaning.

The main container 10 is open at the top and is formed with a lateral protuberance 11 for the reception of an end fitting (not shown) of a suction hose leading to a cleaning head incorporating a suction chamber which is applied directly to a carpet or other like surface to be cleaned, in a manner well known in the art. The protuberance 11 is formed with a circular aperture 12 adapted to receive the suction hose end fitting, and an intake opening 14 is formed opposite to the aperture 12 in the upper portion of the side wall of the container 10 so that air, together with any dust or water entrained therein, enters from the hose directly into the interior of the container 10 in a generally radial direction.

The main container 10 also carries a pair of diametrally spaced lugs 15 to which are pivoted retaining clips 16 for the purpose of securing the air suction unit 20 and either the reservoir unit 50 or the connector member assembly 80 to the container 10. The main container 10 is provided with a mobile base 18 equipped with castors 19.

The suction unit 20 comprises an assembly which includes a main outer casing 21 having a carrying handle 22 centrally disposed thereon, and an ON/OFF switch 23 is mounted in the handle. A housing 24 within the handle 22 encloses an electric motor (not shown) and is covered by a ventilated top plate 25. The motor is coupled to an impeller 26 which is disposed in a circular housing defined in combination by an annular wall 27 formed integrally with the main casing 21 and a similar annular wall 28 formed on a base member 30 of the assembly. The impeller 26 is centrally located by an inner annular wall 29 formed on the base member 30 and a corresponding inner annular wall (not shown) afforded by the casing 21.

The base member 30 includes a flat central portion 31 and a frusto-conical outer portion 32, separated by an annular gap 33 and joined by radial ribs 34 at the underside thereof leading from a central ring 35 to a peripheral rib 36. A plurality of holes 37 within the central region of the base member 30 bounded by the ring 35 register with an air intake (not shown) of the impeller 26 and an apertured disc 39 fits within the ring 35 and is flush with the lower edge of the latter. This structure defines an air inlet 38 whereby the impeller draws air in from beneath the top cover assembly 20 through the apertures 37 and the apertured disc 39.

Exhaust air from the impeller 26 is discharged peripherally into an annular chamber 40 defined by the walls 27 and 28 in combination with the casing of the impeller 26. A sealing ring 41 seals the impeller inlet off from the outlet chamber 40 and the gap 33 in the base plate 30, which gap is between the annular walls 28 and 29 and outside the ring 35, defines an exhaust outlet which allows the exhaust air to escape from the chamber 40 to the underside of the base member 30 at a position spaced radially from the air inlet 38 of the suction unit.

The reservoir unit 50 includes a mounting ring 51 which is interposed between the upper edge of the main container 10 and the lower edge of the suction unit 20, as shown in FIGS. 1 and 2 when the appliance is to be used for water extraction cleaning. The ring 51 is formed with a lateral extension 52 which is aligned with the protuberance 11 of the main container 10. A rib 53 which extends around the entire periphery of the ring 51 and the extension 52, at the underside thereof, is adapted to seat within the open top of the container 10 in a substantially airtight fashion, as seen in FIG. 2. A number of vertical internal ribs 54 are disposed within the ring 51 and project slightly above the upper edge to support the base member 30 of the suction unit 20 by engagement with the rib 36 thereof.

The mounting ring 51 also has at its lower edge an inwardly directed flange 55 supporting an integral annular trough 56 which is defined by a generally cylindrical wall 57 and a frusto-conical wall or cone 58. The cone 58 supports a boss 60 which defines an air passageway 64 to place the air inlet 38 of the suction unit 20 in communication with the interior of the container 10 when the reservoir unit 50 is mounted thereon by means of the ring 51. The boss 60 affords at its upper edge a ring 61 which is so positioned as to engage sealingly beneath the central ring 35 of the base member 30.

The boss 60 also includes a funnel-shaped main portion 62 which seats on the apex of the cone 58, and a downward extension 63 which protrudes to the underside of the cone. Thus, when the reservoir unit 50 is interposed between the suction unit 20 and the main container 10, suction generated by the impeller 26 is communicated through the suction inlet 38 and the air passageway 64 defined by the boss 60 to the interior of the container 10, and in this way suction is applied to the hose which, as previously mentioned, is connected to the main container 10 through the aperture 12 so that the induced air flow follows the course indicated by arrows A.

The exhaust air from the impeller 26 follows the course indicated by the arrows B through the gap 33 and enters directly into the reservoir unit 50 through an annular opening defined by the open top of the latter between the boss 60 and the mounting ring 51. As can be seen in FIG. 2, a narrow gap 67 exists between the lower edge of the main casing 21 of the suction unit 20 and the upper edge of the mounting ring 51 of the reservoir unit 50 so as to allow restricted escape of air from the space beneath the cover assembly and cause the establishment of a positive air pressure over the trough 56 of the reservoir unit 50. In this way, sufficient pressure is generated within the trough 56 to displace liquid therefrom through a liquid delivery pipe 65 which is secured by means of a clip 66 in the extension 52 of the mounting ring 51. It will be appreciated that the pressure generated within the reservoir in this way may be relatively low, but it can readily be made sufficient to initiate and maintain a syphoning action, and even to lift the liquid to a height sufficient for the purpose of cleaning upholstery or curtains without unduly reducing the efficiency of the suction unit.

In order to prevent liquid being sucked up into the impeller 26 if the capacity of the main container 10 is exceeded, an overflow valve 70 is provided. This consists of a spherical float 71 confined between three guides 59 which extend downwardly from the centre of cone 58, and a seating face 72 formed at the lower edge of the extension 63 of the boss 60.

When the appliance is to be used for dry suction cleaning, the reservoir unit 50 is removed and the connector member 80 is assembled between the main container 10 and the suction unit 20, as shown in FIG. 4, and retained by means of the clips 16. No other alterations or adjustments are required.

The connector member 80 includes a mounting ring 81 similar to the mounting ring 51 of the reservoir unit 50, with a lateral extension 82 to fit the protuberance 12 of the container 10, and a peripheral rib 83 which engages in a substantially airtight manner within the rim of the container 10, as shown in FIG. 4. A filter element 84 fits within the peripheral rib 83 and serves to separate entrained dust from the air stream, although additionally or alternatively a dust collection bag (not shown) may be provided within the container 10 and attached directly to the end fitting of the hose.

The connector member 80 further includes a frustoconical air flow director member 85 with a central opening 86 bounded by a ring 87 which sealingly engages the underside of the central ring 35 of the base member 30 in the same manner as the ring 61 of the boss 60. Thus, the interior of the container 10 is placed in communication with the suction inlet 37 of the suction unit 20 through the filter element 84, and the induced air flow follows the course indicated by arrows C.

Internal ribs 88, similar to the ribs 54 of the mounting ring of the reservoir unit 50, serve to support the periphery of the base member 30 and ensure that a gap 89 exists between the lower edge of the main casing 21 of the suction unit 20 and the upper edge of the ring 81 so as to enable air to escape freely. The base member 30 and the air flow director member 85 in combination define an annular air outlet passageway 90 leading from the exhaust outlet defined by the gap 33 to the external atmosphere via the gap 89. Thus, exhaust air from the chamber 40 follows the course of arrows D through the gap 33 into the annular outlet passageway 89 and is deflected to atmosphere by the director member 85.

It will thus be seen that the reservoir unit 50 and connector member 80 are directly interchangeable with one another so as to enable the apparatus to be used selectively for either water extraction cleaning or dry suction cleaning. In the one case the exhaust air from the impeller 26 applies pressure to the liquid in the reservoir unit 50 so as to cause the liquid to be delivered along the tube 65 which may lead either directly to a compartment of the cleaning head or to a separate liquid application head. In the other case the director member 85 of the connector member 80 diverts the exhaust air from the impeller 26 to the external atmosphere without requiring any adjustment of the apparatus by the operator and without utilising any moving parts. If, as previously mentioned a dust collecting bag is to be used within the container 10 instead of, or in addition to, the filter disc 84, it is only necessary to ensure that such bag is in place, as in any conventional vacuum cleaner. The apparatus thus cannot be set up incorrectly, for example without diverting the exhaust air to atmosphere when the filter assembly is in place, and there are no moving parts utilised in the control of the air flow which might become jammed so as to lead to improper operation.

Instead of providing the gaps 55 and 89 for the escape of the exhaust air, it would alternatively be possible for the mounting rings 51 and 81 to engage sealingly with the suction unit 20 and afford outlet apertures. Such apertures could be of a calibrated size so as to afford a carefully controlled restriction on the air flow, at least in the case of the reservoir.

I claim:

1. Suction cleaning apparatus comprising:

(a) container means for the collection of both wet and dry matter and having an intake inlet for connection with a cleaning head;

(b) motor driven air suction means with an air exhaust outlet and an air inlet;

(c) detachable reservoir means for storing cleaning liquid;

(d) delivery means for delivering said liquid from said reservoir means to said cleaning head in response to the establishment of air pressure within said reservoir means so as to enable the apparatus to be used for wet cleaning;

(e) detachable connector means for connecting said suction means to said container means, said reservoir means and said connector means being interchangeably assembled with said container means and suction means so that the connector means is used in the absence of said reservoir means and vice-versa;

(f) filter means for assembly with said container means when said connector means is assembled therewith so as to enable the apparatus to be used alternatively for dry suction cleaning;

(g) an air passageway in said reservoir means extending, when said reservoir means is assembled with said container means and said suction means, from the interior of said container means to the air inlet of said suction means so as to apply suction to the interior of said container means whilst isolating said air exhaust outlet of the suction means from said container means so that air delivered from said air exhaust outlet enters the reservoir means externally of said air passageway; and (h) air-flow director means incorporated in said connector means for directing air, when said director means is assembled with said container means and said suction means, from said exhaust outlet of the suction means to atmosphere whilst placing the interior of said container means in communication with said air inlet of the suction means.

2. Apparatus according to claim 1 wherein the container means is open at its upper edge and the reservoir means and the connector means each include a respective mounting ring adapted to engage sealingly with the upper edge of said container means.

3. Apparatus according to claim 2 wherein the air suction means includes a base member which is supported by either said reservoir means or said connector means whilst leaving a gap between said suction means and the mounting ring of said reservoir means or said connector means respectively.

4. Apparatus according to claim 3 wherein the exhaust outlet of said suction means comprises an annular slot which extends around said air inlet.

5. Apparatus according to claim 4 wherein said airflow director means comprises a frusto-conical member having an upper edge which engages sealingly around the air inlet of said suction means and a lower edge which is joined to said mounting ring, the frusto-conical member serving to deflect exhaust air from said exhaust outlet towards said gap between the suction means and the mounting ring of the connector means.

6. Apparatus according to claim 5 wherein said filter means is assembled with said connector means across the lower end of the frusto-conical member.

* * * * *